US006416649B1

(12) United States Patent
Ray et al.

(10) Patent No.: US 6,416,649 B1
(45) **Date of Patent: *Jul. 9, 2002**

(54) ELECTROLYTIC PRODUCTION OF HIGH PURITY ALUMINUM USING CERAMIC INERT ANODES

(75) Inventors: Siba P. Ray, Murrysville; Xinghua Liu, Monroeville; Douglas A. Weirauch, Murrysville, all of PA (US); Robert A. DiMilia, Baton Rouge, LA (US); Joseph M. Dynys, New Kensington, PA (US); Frankie E. Phelps, Apollo, PA (US); Alfred F. LaCamera, Trafford, PA (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/835,595

(22) Filed: Apr. 16, 2001

Related U.S. Application Data

(63) Continuation-in-part of application No. 09/431,756, filed on Nov. 1, 1999, now Pat. No. 6,217,739, which is a continuation-in-part of application No. 09/241,518, filed on Feb. 1, 1999, now Pat. No. 6,126,799, which is a continuation-in-part of application No. 08/883,061, filed on Jun. 26, 1997, now Pat. No. 5,865,980, application No. 09/835,595, which is a continuation-in-part of application No. 09/542,318, filed on Apr. 4, 2000, and a continuation-in-part of application No. 09/542,320, filed on Apr. 4, 2000, now Pat. No. 6,372,119, which is a continuation-in-part of application No. 09/431,756, filed on Nov. 1, 1999, now Pat. No. 6,217,739.

(51) Int. Cl.[7] ..... C25C 3/08

(52) U.S. Cl. ..... 205/387; 205/384; 205/385; 205/386; 205/389; 204/247.3; 204/292; 204/243.1

(58) Field of Search ..... 204/243.1, 247.3, 204/292; 205/384, 385, 386, 387, 389

(56) References Cited

U.S. PATENT DOCUMENTS

| | | | | |
|---|---|---|---|---|
| 3,996,117 | A | 12/1976 | Graham et al. | 204/67 |
| 4,190,516 | A | 2/1980 | Kajimaya et al. | 204/290 R |
| 4,288,302 | A | 9/1981 | de Nora et al. | 204/105 |
| 4,290,859 | A | 9/1981 | Oda et al. | 204/16 |
| 4,302,321 | A | 11/1981 | de Nora et al. | 204/291 |
| 4,374,050 | A | 2/1983 | Ray | 252/519 |
| 4,374,761 | A | 2/1983 | Ray | 252/519 |
| 4,397,729 | A | 8/1983 | Deruz et al. | 204/243 |
| 4,399,008 | A | 8/1983 | Ray | 204/67 |
| 4,455,311 | A | 6/1984 | Ray | 204/293 |
| 4,462,889 | A | 7/1984 | Landon et al. | 204/292 |
| 4,472,258 | A | 9/1984 | Secrist et al. | 204/292 |
| 4,552,630 | A | 11/1985 | Wheeler et al. | 204/67 |
| 4,582,585 | A | 4/1986 | Ray | 204/243 |
| 4,584,172 | A | 4/1986 | Ray et al. | 419/34 |
| 4,620,905 | A | 11/1986 | Tarcy et al. | 204/64 R |
| 4,871,437 | A | 10/1989 | Marschman et al. | 204/291 |
| 4,871,438 | A | 10/1989 | Marschman et al. | 204/291 |
| 4,960,494 | A | 10/1990 | Nguyen et al. | 204/67 |
| 5,019,225 | A | 5/1991 | Darracq et al. | 204/67 |
| 5,137,867 | A | 8/1992 | Ray et al. | 505/1 |
| 5,254,232 | A | 10/1993 | Sadoway | 204/243 |
| 5,279,715 | A | 1/1994 | LaCamera et al. | 204/64 R |
| 5,284,562 | A | 2/1994 | Beck et al. | 204/243 |
| 5,378,325 | A | 1/1995 | Dastolfo, Jr. et al. | 204/66 |
| 5,626,914 | A | 5/1997 | Ritland et al. | 427/377 |
| 5,794,112 | A | 8/1998 | Ray et al. | 419/21 |
| 5,865,980 | A | 2/1999 | Ray et al. | 205/367 |
| 5,904,828 | A | 5/1999 | Sekhar et al. | 205/188 |
| 5,938,914 | A | 8/1999 | Dawless et al. | 205/391 |
| 6,030,518 | A | 2/2000 | Dawless et al. | 205/387 |
| 6,077,415 | A | 6/2000 | Duruz et al. | 205/384 |
| 6,113,758 | A | 9/2000 | de Nora et al. | 204/284 |
| 6,126,799 | A | 10/2000 | Ray et al. | 204/291 |
| 6,162,334 | A1 | 4/2001 | Ray et al. | 204/290.14 |
| 6,217,739 | B1 * | 4/2001 | Ray et al. | 205/385 |

FOREIGN PATENT DOCUMENTS

| | | |
|---|---|---|
| WO | 9936594 | 7/1999 |
| WO | 0044953 | 11/2000 |

OTHER PUBLICATIONS

Belyaev, "Electrolysis of Aluminum with Nonburning Ferrite Anodes", *Legkie Metal.*, 7(1):7–20, 1938.

Billehaug Et Al., "Inert Anodes for Aluminum Electrolysis in Hall–Héroult Cells (I)", *Aluminum*, pp. 146–150, 1981. No month available.

Billehaug Et Al., "Inert Anodes for Aluminum Electrolysis in Hall–Héroult Cells (II)", *Aluminum*, pp. 228–231, 1981. No month available.

Cermet Inert Anode Containing Oxide and Metal Phases Useful for the Electrolytic Production of Metals—Ray et al., U.S. Ser. No. 09/629,332, filed Aug. 1, 2000.

Inert Anode Containing Oxides of Nickel, Iron and Zinc Useful for the Electrolytic Production of Metals—Ray et al., U.S. Ser. No. 09/542,318, filed Apr. 4, 2000.

Inert Anode Containing Oxides of Nickel, Iron and Cobalt Useful for the Electrolytic Production of Metals—Ray et al., U.S. Ser. No. 09/542,320, filed Apr. 4, 2000.

* cited by examiner

*Primary Examiner*—Bruce F. Bell
(74) *Attorney, Agent, or Firm*—Alan G. Towner; Edward L. Levine

(57) ABSTRACT

A method of producing commercial purity aluminum in an electrolytic reduction cell comprising ceramic inert anodes is disclosed. The method produces aluminum having acceptable levels of Fe, Cu and Ni impurities. The ceramic inert anodes used in the process may comprise oxides containing Fe and Ni, as well as other oxides, metals and/or dopants.

29 Claims, 5 Drawing Sheets

ELECTROLYTIC PRODUCTION OF HIGH PURITY ALUMINUM USING CERAMIC INERT ANODES

CROSS REFERENCE TO RELATED APPLICATIONS

This application is a continuation-in-part of U.S. Ser. No. 09/431,756 filed Nov. 1, 1999, now U.S. Pat. No. 6,217,739, which is a continuation-in-part of U.S. Ser. No. 09/241,518 filed Feb. 1, 1999, now U.S. Pat. No. 6,126,799, which is a continuation-in-part of U.S. Ser. No. 08/883,061 filed Jun. 26, 1997, now U.S. Pat. No. 5,865,980 issued Feb. 2, 1999. This application is also a continuation-in-part of both U.S. Ser. No. 09/542,318 filed Apr. 4, 2000 and U.S. Ser. No. 09/542,320 filed Apr. 4, 2000, now U.S. Pat. No. 6,372,119 which are continuations-in-part of U.S. Ser. No. 09/431,756 filed Nov. 1, 1999 now U.S. Pat. No. 6,217,739. All of these applications and patents are incorporated herein by reference.

GOVERNMENT CONTRACT

The United States Government has certain rights in this invention pursuant to Contract No. DE-FC07-98ID13666 awarded by the United States Department of Energy.

FIELD OF THE INVENTION

The present invention relates to the electrolytic production of aluminum. More particularly, the invention relates to the production of commercial purity aluminum with an electrolytic reduction cell including ceramic inert anodes.

BACKGROUND OF THE INVENTION

The energy and cost efficiency of aluminum smelting can be significantly reduced with the use of inert, nonconsumable and dimensionally stable anodes. Replacement of traditional carbon anodes with inert anodes should allow a highly productive cell design to be utilized, thereby reducing capital costs. Significant environmental benefits are also possible because inert anodes produce no $CO_2$ or $CF_4$ emissions. Some examples of inert anode compositions are provided in U.S. Pat. Nos. 4,374,050, 4,374,761, 4,399,008, 4,455,211, 4,582,585, 4,584,172, 4,620,905, 5,794,112, 5,865,980 and 6,126,799, assigned to the assignee of the present application. These patents are incorporated herein by reference.

A significant challenge to the commercialization of inert anode technology is the anode material. Researchers have been searching for suitable inert anode materials since the early years of the Hall-Heroult process. The anode material must satisfy a number of very difficult conditions. For example, the material must not react with or dissolve to any significant extent in the cryolite electrolyte. It must not react with oxygen or corrode in an oxygen-containing atmosphere. It should be thermally stable at temperatures of about 1,000° C. It must be relatively inexpensive and should have good mechanical strength. It must have high electrical conductivity at the smelting cell operating temperatures, e.g., about 900–1,000° C., so that the voltage drop at the anode is low and stable during anode service life.

In addition to the above-noted criteria, aluminum produced with the inert anodes should not be contaminated with constituents of the anode material to any appreciable extent. Although the use of inert anodes in aluminum electrolytic reduction cells has been proposed in the past, the use of such inert anodes has not been put into commercial practice. One reason for this lack of implementation has been the long-standing inability to produce aluminum of commercial grade purity with inert anodes. For example, impurity levels of Fe, Cu and/or Ni have been found to be unacceptably high in aluminum produced with known inert anode materials.

The present invention has been developed in view of the foregoing, and to address other deficiencies of the prior art.

SUMMARY OF THE INVENTION

An aspect of the present invention is to provide a process for producing high purity aluminum using inert anodes. The method includes the steps of passing current between a ceramic inert anode and a cathode through a bath comprising an electrolyte and aluminum oxide, and recovering aluminum comprising a maximum of 0.2 weight percent Fe, 0.1 weight percent Cu, and 0.034 weight percent Ni.

Another aspect of the present invention is to provide a method of making a ceramic inert anode that is useful for producing commercial purity aluminum. The method includes the step of mixing metal oxide powders, and sintering the metal oxide powder mixture in a substantially inert atmosphere. A preferred atmosphere comprises argon and from 5 to 5,000 ppm oxygen.

Additional aspects and advantages of the invention will occur to persons skilled in the art from the following detailed description thereof.

DETAILED DESCRIPTION

Figure 1:
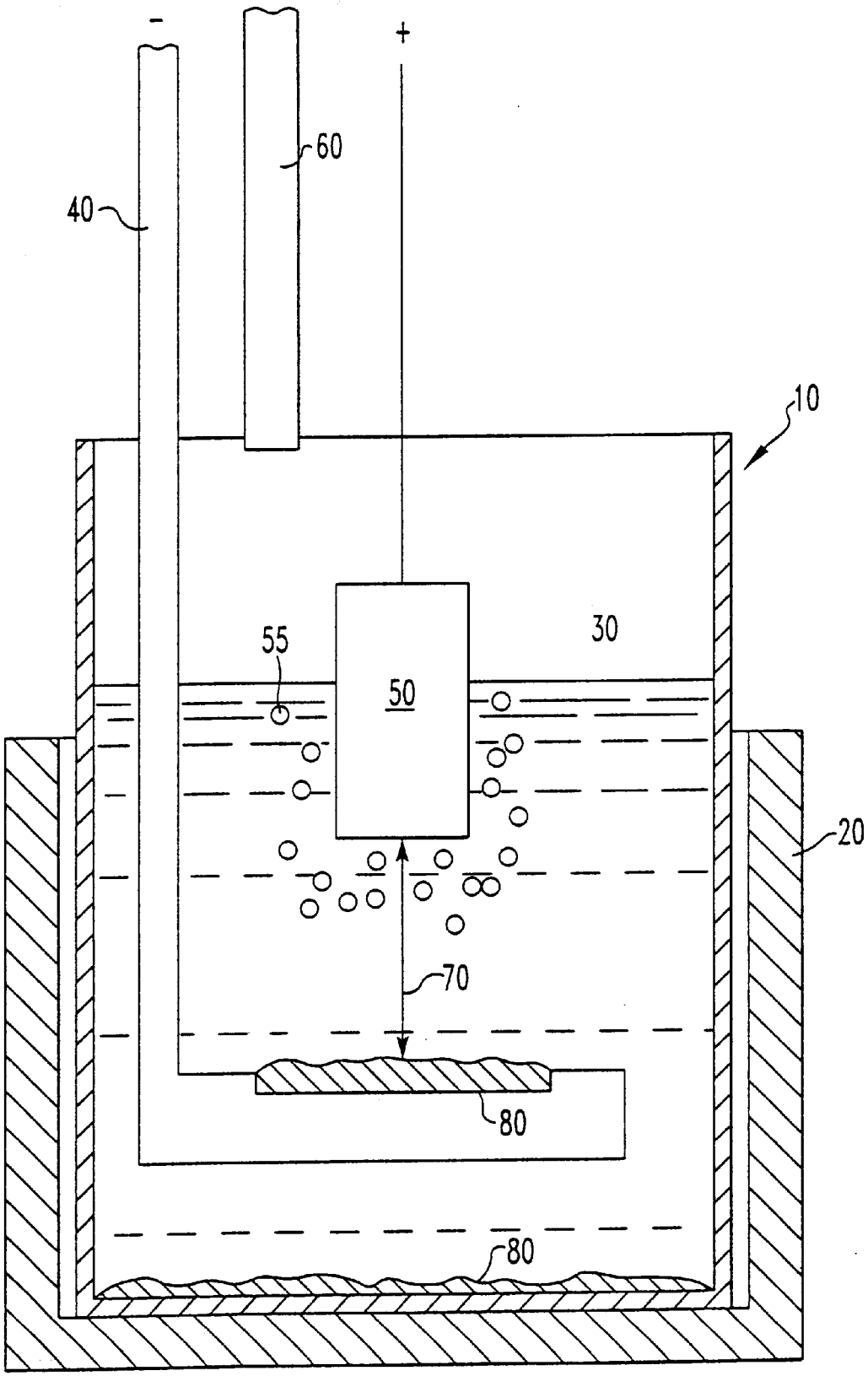
FIG. 1 is a partially schematic sectional view of an electrolytic cell with an inert anode that is used to produce commercial purity aluminum in accordance with the present invention.

FIG. 1 schematically illustrates an electrolytic cell for the production of commercial purity aluminum which includes a ceramic inert anode in accordance with an embodiment of the present invention. The cell includes an inner crucible 10 inside a protection crucible 20. A cryolite bath 30 is contained in the inner crucible 10, and a cathode 40 is provided in the bath 30. A ceramic inert anode 50 is positioned in the bath 30. An alumina feed tube 60 extends partially into the inner crucible 10 above the bath 30. The cathode 40 and ceramic inert anode 50 are separated by a distance 70 known as the anode-cathode distance (ACD). Commercial purity aluminum 80 produced during a run is deposited on the cathode 40 and on the bottom of the crucible 10.

As used herein, the term "ceramic inert anode" means a substantially nonconsumable, ceramic-containing anode which possesses satisfactory corrosion resistance and stability during the aluminum production process. The ceramic inert anode may comprise oxides such as iron and nickel oxides plus optional additives and/or dopants.

As used herein, the term "commercial purity aluminum" means aluminum which meets commercial purity standards upon production by an electrolytic reduction process. The commercial purity aluminum comprises a maximum of 0.2 weight percent Fe, 0.1 weight percent Cu, and 0.034 weight percent Ni. In a preferred embodiment, the commercial purity aluminum comprises a maximum of 0.15 weight percent Fe, 0.034 weight percent Cu, and 0.03 weight percent Ni. More preferably, the commercial purity aluminum comprises a maximum of 0.13 weight percent Fe, 0.03 weight percent Cu, and 0.03 weight percent Ni. Preferably, the commercial purity aluminum also meets the following weight percentage standards for other types of impurities: 0.2 maximum Si, 0.03 Zn. and 0.03 Co. The Si impurity level is more preferably kept below 0.15 or 0.10 weight percent. It is noted that for every numerical range or limit set forth herein, all numbers with the range or limit including every fraction or decimal between its stated minimum and maximum, are considered to be designated and disclosed by this description.

At least a portion of the inert anode of the present invention preferably comprises at least about 90 weight percent ceramic, for example, at least about 95 weight percent. In a particular embodiment, at least a portion of the inert anode is made entirely of a ceramic material. The inert anode may optionally include additives and/or dopants in amounts up to about 10 weight percent, for example, from about 0.1 to about 5 weight percent. Suitable additives include metals such as Cu, Ag, Pd, Pt and the like, e.g., in amounts of from about 0.1 to about 8 weight percent of the ceramic inert anode. Suitable dopants include oxides of Co, Cr, Al, Ga, Ge, Hf, In, Ir, Mo, Mn, Nb, Os, Re, Rh, Ru, Se, Si, Sn, Ti, V, W, Zr, Li, Ca, Ce, Y and F. Preferred dopants include oxides of Al, Mn, Nb, Ti, V, Zr and F. The dopants may be used, for example, to increase the electrical conductivity of the ceramic inert anode. It is desirable to stabilize electrical conductivity in the Hall cell operating environment. This can be achieved by the addition of suitable dopants and/or additives.

The ceramic preferably comprises iron and nickel oxides, and at least one additional oxide such as zinc oxide and/or cobalt oxide. For example, the ceramic may be of the formula: $Ni_{1-x-y}Fe_{2-x}M_yO$; where M is preferably Zn and/or Co; x is from 0 to 0.5; and y is from 0 to 0.6. More preferably X is from 0.05 to 0.2, and y is from 0.01 to 0.5.

Table 1 lists some ternary Fe—Ni—Zn—O materials that may be suitable for use as the ceramic an inert anode.

TABLE 1

| Sample I.D. | Nominal Composition | Elemental wt. % Fe, Ni, Zn | Structural Types |
|---|---|---|---|
| 5412 | $NiFe_2O_4$ | 48, 23.0, 0.15 | $NiFe_2O_4$ |
| 5324 | $NiFe_2O_4$ + NiO | 34, 36, 0.06 | $NiFe_2O_4$, NiO |
| E4 | $Zn_{0.05}Ni_{0.95}Fe_2O_4$ | 43, 22, 1.4 | $NiFe_2O_4$,TU* |
| E3 | $Zn_{0.1}Ni_{0.9}Fe_2O_4$ | 43, 20, 2.7 | $NiFe_2O_4$,TU* |
| E2 | $Zn_{0.25}Ni_{0.75}Fe_2O_4$ | 40, 15, 5.9 | $NiFe_2O_4$,TU* |
| E1 | $Zn_{0.25}Ni_{0.75}Fe_{1.90}O_4$ | 45, 18, 7.8 | $NiFe_2O_4$,TU* |
| E | $Zn_{0.5}Ni_{0.5}Fe_2O_4$ | 45, 12, 13 | $(ZnNi)Fe_2O_4$,$TP^+$$ZnO^S$ |
| F | $ZnFe_2O_4$ | 43, 0.03, 24 | $ZnFe_2O_4$,$TP^+$ZnO |
| H | $Zn_{0.5}NiFe_{1.5}O_4$ | 33 ,23, 13 | $(ZnNi)Fe_2O_4$,$NiO^S$ |

TABLE 1-continued

| Sample I.D. | Nominal Composition | Elemental wt. % Fe, Ni, Zn | Structural Types |
|---|---|---|---|
| J | $Zn_{0.5}Ni_{1.5}FeO_4$ | 26, 39, 10 | $NiFe_2O_4$,$MP^+$NiO |
| L | $ZnNiFeO_4$ | 22, 23, 27 | $(ZnNi)Fe_2O_4$,$NiO^S$,ZnO |
| ZD6 | $Zn_{0.05}Ni_{1.05}Fe_{1.9}O_4$ | 40, 24, 1.3 | $NiFe_2O_4$,TU* |
| ZD5 | $Zn_{0.1}Ni_{1.1}Fe_{1.8}O_4$ | 29, 18, 2.3 | $NiFe_2O_4$,TU* |
| ZD3 | $Zn_{0.12}Ni_{0.94}Fe_{1.88}O_4$ | 43, 23, 3.2 | $NiFe_2O_4$,TU* |
| ZD1 | $Zn_{0.12}Ni_{0.94}Fe_{1.88}O_4$ | 40, 20, 11 | $(ZnNi)Fe_2O_4$,TU* |
| DH | $Zn_{0.18}Ni_{0.96}Fe_{1.8}O_4$ | 42, 23, 4.9 | $NiFe_2O_4$,$TP^+$NiO |
| DI | $Zn_{0.08}Ni_{1.17}Fe_{1.5}O_4$ | 38, 30, 2.4 | $NiFe_2O_4$,$MP^+$NiO,TU* |
| DJ | $Zn_{0.17}Ni_{1.1}Fe_{1.5}O_4$ | 36, 29, 4.8 | $NiFe_2O_4$,$MP^+$NiO |
| BC2 | $Zn_{0.33}Ni_{0.67}O$ | 0.11, 52, 25 | $NiO^S$,TU* |

Figure 2:
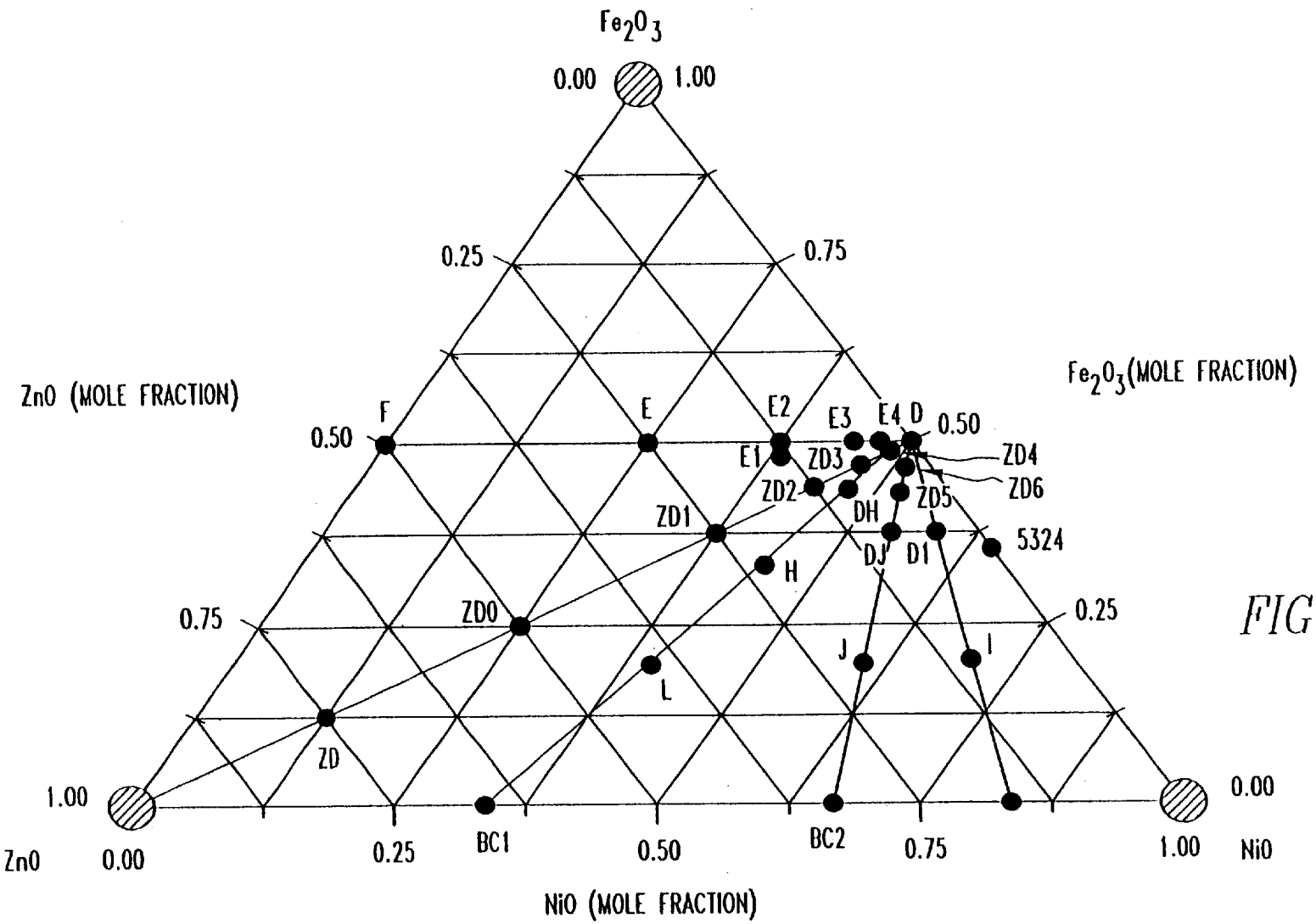
FIG. 2 is a ternary phase diagram illustrating amounts of iron, nickel and zinc oxides present in a ceramic inert anode that may be used to make commercial purity aluminum in accordance with an embodiment of the present invention.

TU* means trace unidentified;
$TP^+$ means trace possible;
$MP^+$ means minor possible;
$^S$means shifted peak FIG. 2 is a ternary phase diagram illustrating the amounts of $Fe_2O_3$, NiO and ZnO starting materials used to make the compositions listed in Table 1, which may be used as the ceramic of the inert anodes. Such ceramic inert anodes may in turn be used to produce commercial purity aluminum in accordance with the present invention.

In one embodiment, when $Fe_2O_3$, NiO and ZnO are used as starting materials for making an inert anode, they are typically mixed together in ratios of 20 to 99.09 mole percent NiO, 0.01 to 51 mole percent $Fe_2O_3$, and zero to 30 mole percent ZnO. Perferably, such starting materials are mixed together in ratios of 45 to 65 mole percent NiO, 20 to 45 mole percent $Fe_2O_3$, and 0.01 to 22 mole percent ZnO.

Table 2 lists some ternary $Fe_2O_3$/NiO/CoO materials that may be suitable as the ceramic of an inert anode.

TABLE 2

| Sample I.D. | Nominal Composition | Analyzed Elemental wt. % Fe, Ni, Co | Structural Types |
|---|---|---|---|
| CF | $CoFe_2O_4$ | 44, 0.17, 24 | $CoFe_2O_4$ |
| NCF1 | $Ni_{0.5}Co_{0.5}Fe_2O_4$ | 44, 12, 11 | $NiFe_2O_4$ |
| NCF2 | $Ni_{0.7}Co_{0.3}Fe_2O_4$ | 45, 16, 7.6 | $NiFe_2O_4$ |
| NCF3 | $Ni_{0.7}Co_{0.3}Fe_{1.95}O_4$ | 42, 18, 6.9 | $NiFe_2O_4$,TU* |
| NCF4 | $Ni_{0.85}Co_{0.15}Fe_{1.95}O_4$ | 44, 20, 3.4 | $NiFe_2O_4$ |
| NCF5 | $Ni_{0.85}Co_{0.5}Fe_{1.9}O_4$ | 45, 20, 7.0 | $NiFe_2O_4$,NiO,TU* |
| NF | $NiFe_2O_4$ | 48, 23, 0 | N/A |

TU* means trace unidentified

Figure 3:
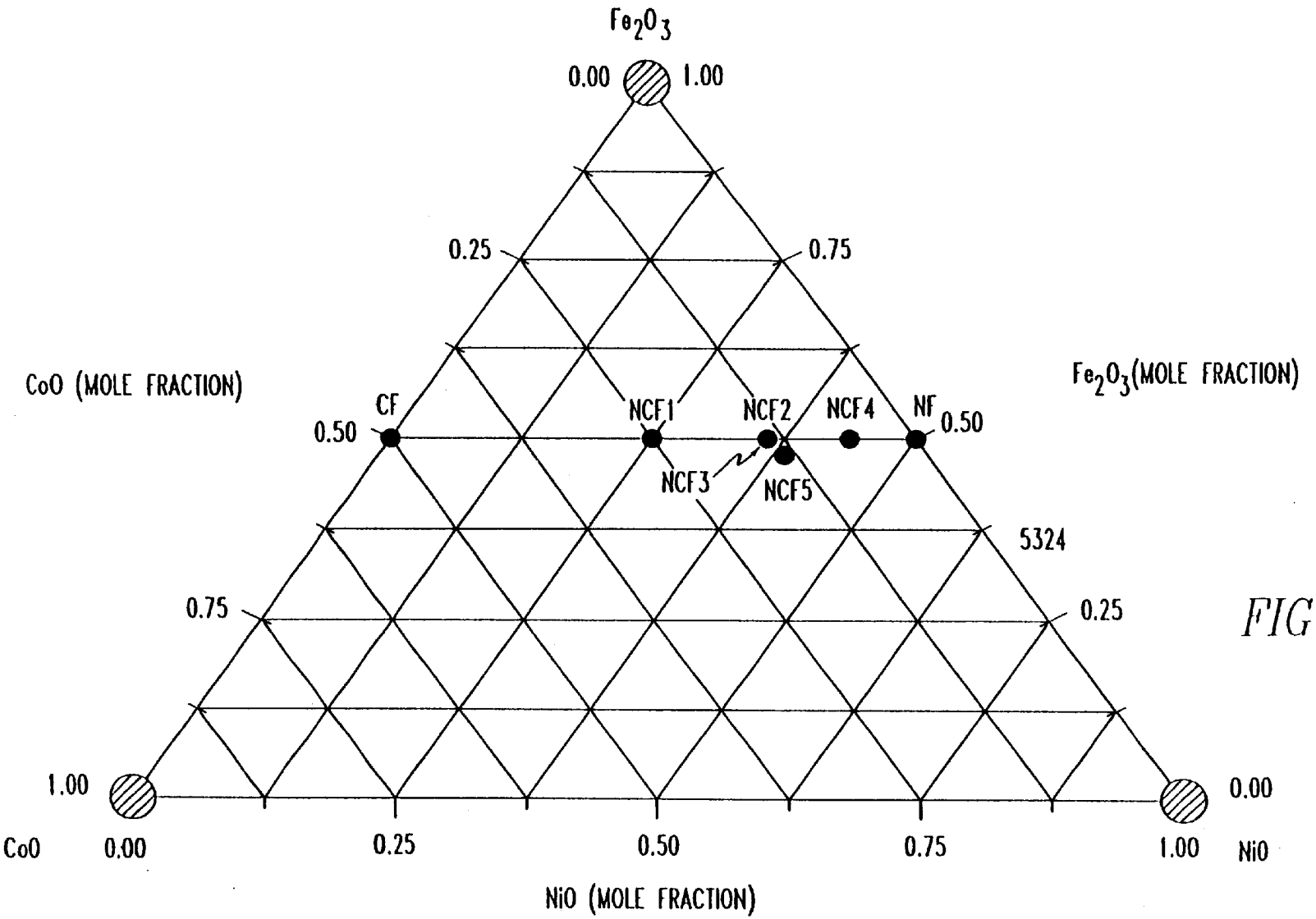
FIG. 3 is a ternary phase diagram illustrating amounts of iron, nickel and cobalt oxides present in a ceramic inert anode that may be used to make commercial purity aluminum in accordance with another embodiment of the present invention.

FIG. 3 is a ternary phase diagram illustrating the amounts of $Fe_2O_3$, NiO and CoO starting materials used to make the compositions listed in Table 2, which may be used as the ceramic of the inert anodes. Such ceramic inert anodes may in turn be used to produce commercial purity aluminum in accordance with the present invention The inert anodes may be formed by techniques such as powder sintering, sol-gel processes, slip casting and spray forming. Preferably, the inert anodes are formed by powder techniques in which powders comprising the oxides and any dopants are pressed and sintered. The inert anode may comprise a monolithic component of such materials, or may comprise a substrate having at least one coating or layer of such material.

The ceramic powders, such as NiO, $Fe_2O_3$ and ZnO or CoO, may be blended in a mixer. Optionally, the blended ceramic powders may be ground to a smaller size before being transferred to a furnace where they are calcined, e.g., for 12 hours at 1,250° C. The calcination produces a mixture made from oxide phases, for example, as illustrated in FIGS. 2 and 3. If desired, the mixture may include other oxide powders such as $Cr_2O_3$ and/or other dopants.

The oxide mixture may be sent to a ball mill where it is ground to an average particle size of approximately 10 microns. The fine oxide particles are blended with a polymeric binder and water to make a slurry in a spray dryer. About 1–10 parts by weight of an organic polymeric binder may be added to 100 parts by weight of the oxide particles. Some suitable binders include polyvinyl alcohol, acrylic polymers, polyglycols, polyvinyl acetate, polyisobutylene, polycarbonates, polystyrene, polyacrylates, and mixtures and copolymers thereof. Preferably, about 3–6 parts by weight of the binder are added to 100 parts by weight of the oxides. The slurry contains, e.g., about 60 weight percent solids and about 40 weight percent water. Spray drying the slurry produces dry agglomerates of the oxides.

The spray dried oxide material may be sent to a press where it is isostatically pressed, for example at 10,000 to 40,000 psi, into anode shapes. A pressure of about 20,000 psi is particularly suitable for many applications. The pressed shapes may be sintered in a controlled atmosphere furnace supplied with, for example, argon/oxygen, nitrogen/oxygen, $H_2/H_2O$ or $Co/Co_2$ gas mixtures, as well as nitrogen, air or oxygen atmospheres. For example, the gas supplied during sintering may contain about 5–5,000 ppm oxygen, e.g., about 100 ppm, while the remainder of the gaseous atmosphere may comprise an inert gas such as nitrogen or argon. Sintering temperatures of 1,000–1,400° C. may be suitable. The furnace is typically operated at about 1,250–1,295° C. for 2–4 hours. The sintering process bums out any polymeric binder from the anode shapes.

The sintered anode may be connected to a suitable electrically conductive support member within an electrolytic metal production cell by means such as welding, brazing, mechanically fastening, cementing and the like.

The inert anode may include a ceramic as described above successively connected in series to a cermet transition region and a nickel end. A nickel or nickel-chromium alloy rod may be welded to the nickel end. The cermet transition region, for example, may include four layers of graded composition, ranging from 25 weight percent Ni adjacent the ceramic end and then 50, 75 and 100 weight percent Ni, balance the oxide powders described above.

We prepared an inert anode composition of 65.65 weight percent $Fe_2O_3$, 32.35 weight percent NiO and 2 weight percent ZnO in accordance with the procedures described above having a diameter of about ⅝ inch and a length of about 5 inches. The starting oxides were ground, calcined and spray dried, followed by isostatic pressing at 20,000 psi and sintering at 1,295° C. in an atmosphere of nitrogen and 100 ppm oxygen. The composition was evaluated in a Hall-Heroult test cell similar to that schematically illustrated in FIG. 1. The cell was operated for 90 hours at 960° C. with an aluminum fluoride to sodium fluoride bath ratio of 1.1 and alumina concentration maintained near saturation at about 7–7.5 weight percent. The impurity concentrations in aluminum produced by the cell are shown in Table 3. The impurity values shown in Table 3 were to 90 hours.

TABLE 3

| Time (hours) | Fe | Cu | Ni |
|---|---|---|---|
| 0 | 0.057 | 0.003 | 0.002 |
| 1 | 0.056 | 0.003 | 0.002 |
| 23 | 0.079 | 0.005 | 0.009 |
| 47 | 0.110 | 0.006 | 0.021 |
| 72 | 0.100 | 0.006 | 0.027 |
| 90 | 0.133 | 0.006 | 0.031 |

Figure 4:
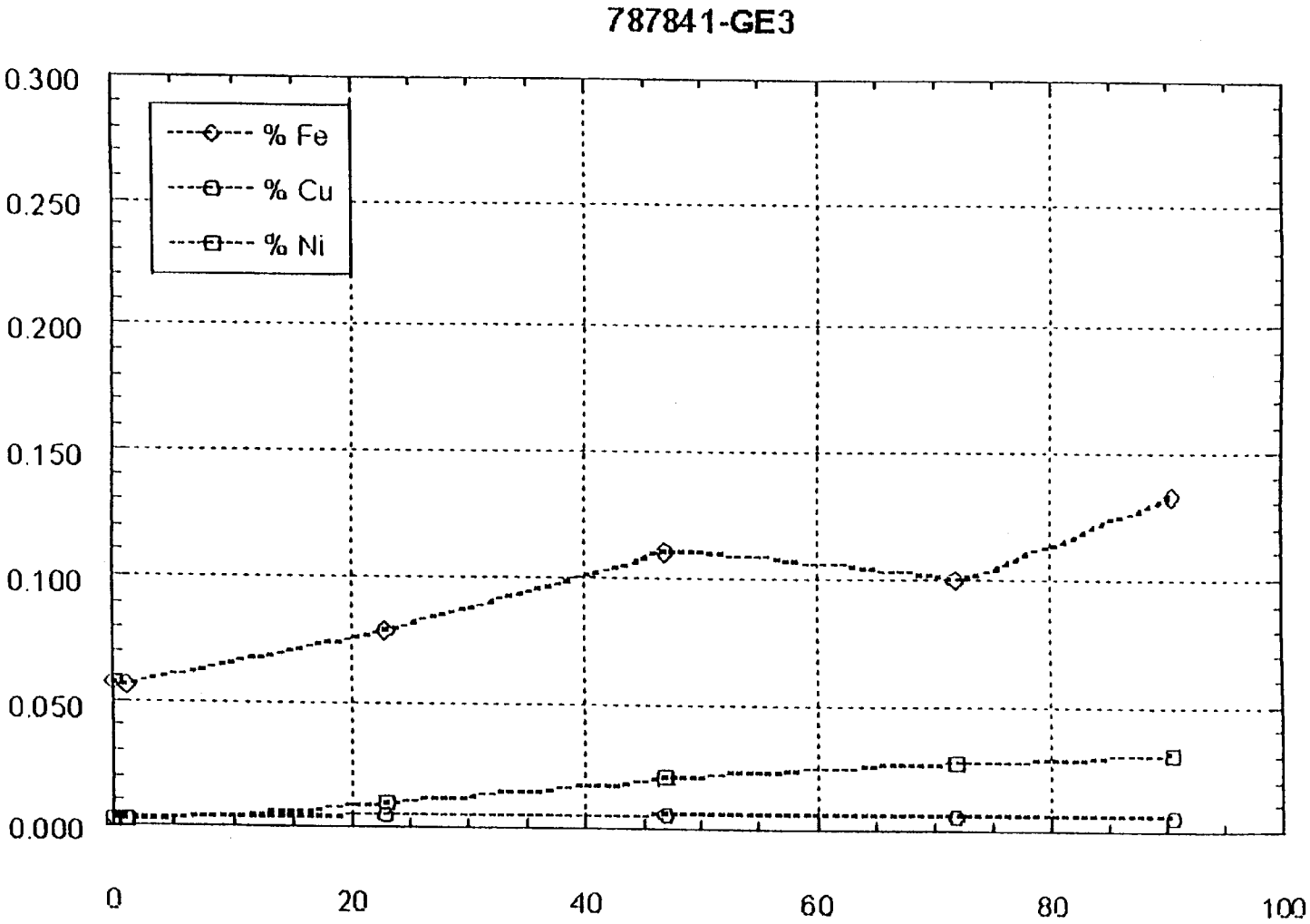
FIG. 4 is a graph illustrating Fe, Cu and Ni impurity levels of aluminum produced during a 90 hour test with an Fe—Ni—Zn oxide ceramic inert anode of the present invention.

The results are graphically shown in FIG. 4. The results in Table 3 and FIG. 4 show low levels of aluminum contamination by the ceramic inert anode. In addition, the inert anode wear rate was extremely low. Optimization of processing parameters and cell operation may further improve the purity of aluminum produced in accordance with the invention.

Figure 5:
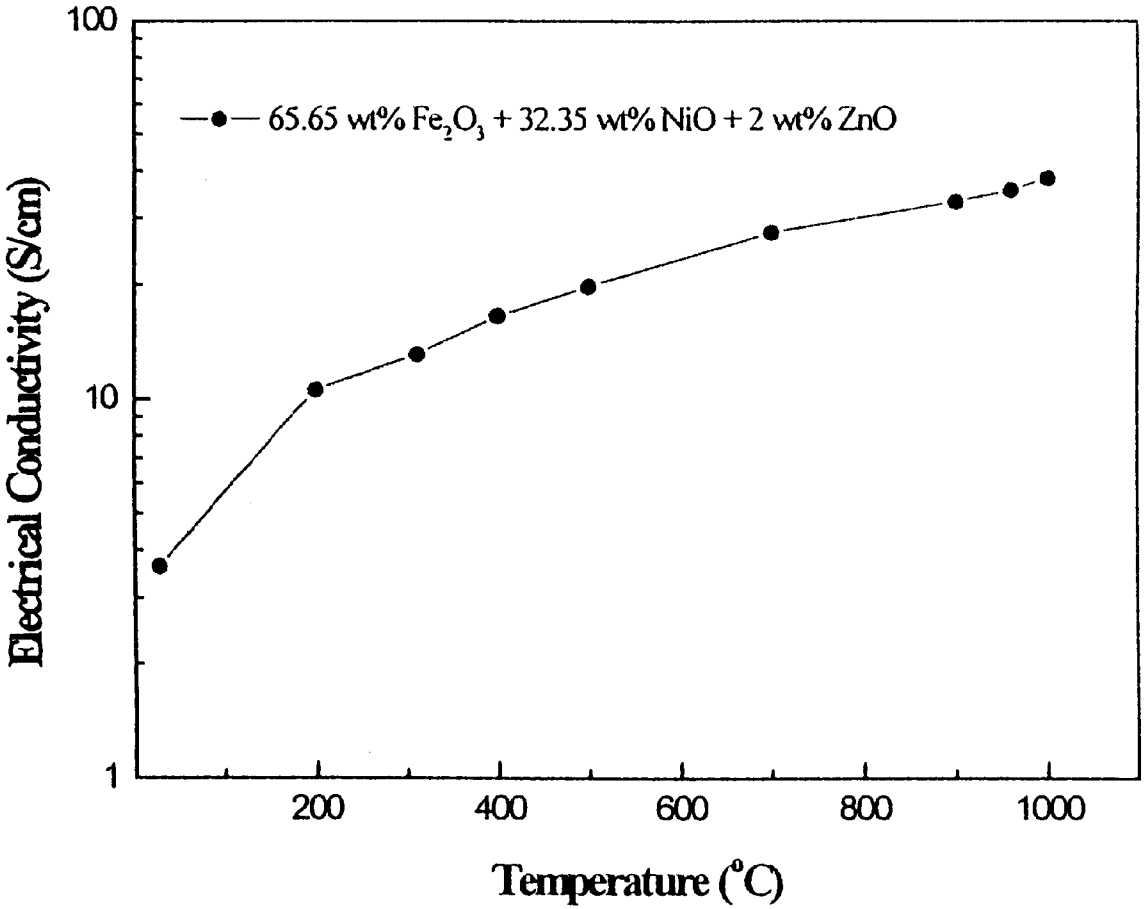
FIG. 5 is a graph illustrating electrical conductivity versus temperature of an Fe—Ni—Zn oxide ceramic inert anode material of the present invention.

FIG. 5 is a graph illustrating electrical conductivity of an Fe—Ni—Zn oxide inert anode material at different temperatures. The ceramic inert anode material was made as described above, except it was sintered in an atmosphere of argon with about 100 ppm oxygen. Electrical conductivity was measured by a four-probe DC technique in argon as a function of temperature ranging from room temperature to 1,000° C. At each temperature, the voltage and current was measured, and the electrical conductivity was obtained by Ohm's law. As shown in FIG. 5, at temperatures of about 900 to 1,000° C. typical of operating aluminum production cells, the electrical conductivity of the ceramic inert anode material is greater than 30 S/cm, and may reach 40 S/cm or higher at such temperatures. In addition to high electrical conductivity, the ceramic inert anode exhibited good stability characteristics. During a three-week test at 960° C., the anode maintained about 75% of its initial conductivity.

The present ceramic inert anodes are particularly useful in electrolytic cells for aluminum production operated at temperatures in the range of about 800–1,000° C. A particularly preferred cell operates at a temperature of about 900–980° C., preferably about 930–970° C. An electric current is passed between the inert anode and a cathode through a molten salt bath comprising an electrolyte and an oxide of the metal to be collected. In a preferred cell for aluminum production, the electrolyte comprises aluminum fluoride and sodium fluoride and the metal oxide is alumina. The weight ratio of sodium fluoride to aluminum fluoride is about 0.7 to 1.25, preferably about 1.0 to 1.20. The electrolyte may also contain calcium fluoride, lithium fluoride and/or magnesium fluoride.

While the invention has been described in terms of preferred embodiments, various changes, additions and modifications may be made without departing from the scope of the invention as set forth in the following claims.

What is claimed is:

1. A method of producing commercial purity aluminum comprising:

passing current between a ceramic inert anode and a cathode through a bath comprising an electrolyte and aluminum oxide; and recovering aluminum comprising a maximum of 0.2 weight percent Fe, a maximum of 0.1 weight percent Cu, and a maximum of 0.034 weight percent Ni.

2. The method of claim 1, wherein the ceramic inert anode comprises an oxide containing Fe.

3. The method of claim 1, wherein the ceramic inert anode comprises an oxide containing Ni.

4. The method of claim 1, wherein the ceramic inert anode comprises an oxide containing Fe and Ni.

5. The method of claim 4, wherein the ceramic inert anode further comprises Zn oxide and/or Co oxide.

6. The method of claim 1, wherein the ceramic inert anode is made from $Fe_2O_3$, NiO and ZnO.

7. The method of claim 1, wherein the ceramic inert anode comprises at least one ceramic phase of the formula $Ni_{1-x-y}Fe_{2-x}M_yO_4$, where M is Zn and/or Co, x is from 0 to 0.5 and y is from 0 to 6.

8. The method of claim 7, wherein M is Zn.

9. The method of claim 8, wherein x is from 0.05 to 0.2 and y is from 0.01 to 0.5.

10. The method of claim 7, wherein M is Co.

11. The method of claim 10, wherein x is from 0.05 to 0.2 and y is from 0.01 to 0.5.

12. The method of claim 1, wherein the ceramic inert anode is made from a composition comprising about 65.65 weight percent $Fe_2O_3$, about 32.35 weight percent NiO, and about 2 weight percent ZnO.

13. The method of claim 1, wherein the ceramic inert anode comprises at least one metal in a total amount of up to 10 weight percent.

14. The method of claim 13, wherein the at least one metal comprises Cu, Ag, Pd, Pt or a combination thereof.

15. The method of claim 14, wherein the at least one metal comprises from about 0.1 to about 8 weight percent of the ceramic inert anode.

16. The method of claim 1, wherein the ceramic inert anode further comprises at least one dopant selected from oxides of Co, Cr, Al, Ga, Ge, Hf, In, Ir, Mo, Mn, Nb, Os, Re, Rh, Ru, Se, Si, Sn, Ti, V, W, Zr, Li, Ca, Ce, Y and F in a total amount of up to 10 weight percent.

17. The method of claim 16, wherein the at least one dopant is selected from oxides of Al, Mn, Nb, Ti, V, Zr and F.

18. The method of claim 1, wherein the ceramic inert anode has an electrical conductivity of at least about 30 S/cm at a temperature of 1,000° C.

19. The method of claim 1, wherein the ceramic inert anode has an electrical conductivity of at least about 40 S/cm at a temperature of 1,000° C.

20. The method of claim 1, wherein the recovered aluminum comprises less than 0.18 weight percent Fe.

21. The method of claim 1, wherein the recovered aluminum comprises a maximum of 0.15 weight percent Fe, 0.034 weight percent Cu, and 0.03 weight percent Ni.

22. The method of claim 1, wherein the recovered aluminum comprises a maximum of 0.13 weight percent Fe, 0.03 weight percent Cu, and 0.03 weight percent Ni.

23. The method of claim 1, wherein the recovered aluminum further comprises a maximum of 0.2 weight percent Si, 0.03 weight percent Zn, and 0.03 weight percent Co.

24. The method of claim 1, wherein the recovered aluminum comprises a maximum of 0.10 weight percent of the total of the Cu, Ni and Co.

25. A method of making a ceramic inert anode for producing commercial purity aluminum, the method comprising:

mixing metal oxide powders; and sintering the metal oxide powder mixture in a substantially inert atmosphere.

26. The method of claim 25, wherein the substantially inert atmosphere comprises argon.

27. The method of claim 26, wherein the substantially inert atmosphere comprises oxygen.

28. The method of claim 27, wherein the oxygen comprises from about 5 to about 5,000 ppm of the substantially inert atmosphere.

29. The method of claim 27 wherein the oxygen comprises from about 50 to about 500 ppm of the substantially inert atmosphere.

* * * * *

UNITED STATES PATENT AND TRADEMARK OFFICE

CERTIFICATE OF CORRECTION

PATENT NO. : 6,416,649 B1 
DATED : July 9, 2002
INVENTOR(S) : Siba P. Ray et al.

It is certified that error appears in the above-identified patent and that said Letters Patent is hereby corrected as shown below:

Title page,
Item [56], References Cited, U.S. PATENT DOCUMENTS,
"4,455,311 A" should read -- 4,455,211 A --.

Column 5,
Line 36, "bums" should read -- burns --.

Column 7,
Line 10, "6" should read -- 0.6 --.

Signed and Sealed this

Sixteenth Day of December, 2003

JAMES E. ROGAN
*Director of the United States Patent and Trademark Office*